US005298381A

United States Patent [19]

Inoue et al.

[11] Patent Number: 5,298,381

[45] Date of Patent: Mar. 29, 1994

[54] DIRECT POSITIVE SILVER HALIDE PHOTOGRAPHIC LIGHT-SENSITIVE MATERIAL

[75] Inventors: Nobuaki Inoue; Takahiro Goto, both of Kanagawa, Japan

[73] Assignee: Fuji Photo Film Co., Ltd., Kanagawa, Japan

[21] Appl. No.: 846,069

[22] Filed: Mar. 5, 1992

[30] Foreign Application Priority Data

Mar. 6, 1991 [JP] Japan ..... 3-63701
Apr. 3, 1991 [JP] Japan ..... 3-96072

[51] Int. Cl.[5] ..... G03C 1/485

[52] U.S. Cl. ..... 430/517; 430/510; 430/512; 430/513; 430/523; 430/596; 430/604; 430/961

[58] Field of Search ..... 430/517, 596, 522, 510, 430/512, 513, 604, 523, 961

[56] References Cited

U.S. PATENT DOCUMENTS

| | | | |
|---|---|---|---|
| 4,849,326 | 7/1989 | Besio et al. | 430/517 |
| 4,933,272 | 6/1990 | McDugle et al. | 430/596 |
| 4,948,717 | 8/1990 | Diehl et al. | 430/517 |
| 5,098,818 | 3/1992 | Ito et al. | 430/517 |

*Primary Examiner*—Thorl Chea
*Attorney, Agent, or Firm*—Sughrue, Mion, Zinn, Macpeak & Seas

[57] ABSTRACT

A direct positive type silver halide photographic light-sensitive material is disclosed, having improved safe-light stability and which is capable of providing an image having excellent photographic properties. The light-sensitive material comprises a support having thereon at least one pre-fogged light-sensitive silver halide emulsion layer and at least one light-insensitive hydrophilic colloid layer provided farther from the support than the light-sensitive silver halide emulsion layer. The light-insensitive hydrophilic colloid layer contains a dye dispersed therein in the form of micro-crystalline particles.

6 Claims, 1 Drawing Sheet

DIRECT POSITIVE SILVER HALIDE PHOTOGRAPHIC LIGHT-SENSITIVE MATERIAL

FIELD OF THE INVENTION

The present invention relates to a silver halide photographic light-sensitive material containing a pre-fogged direct positive type silver halide emulsion, and more specifically to a direct positive silver halide photographic light-sensitive material having improved photographic properties.

BACKGROUND OF THE INVENTION

A direct positive silver halide photographic light-sensitive material is used for copying various photographs. In a photomechanical process, a direct positive silver halide light-sensitive material in many cases is used for printing an original halftone dot image from a positive to a positive or from a negative to a negative in a dot to dot work step. The photographic light-sensitive material used for this dot to dot work step is desirably handled under a safelight. Photographic light-sensitive materials which can be handled under orthochromatic and panchromatic safelights are known; however the working efficiency is reduced when using a safelight having such a wavelength and the cost for photomechanical process is increased. For solving these problems, there has recently been developed a photographic light-sensitive material (hereinafter referred to as a daylight photographic light-sensitive material) capable of being handled even under a safelight of a visible ray (a safelight emitting primarily a ray having a wavelength of 450 nm or longer).

However, a direct positive silver halide photographic light-sensitive material having sufficient resistance to a safelight of a visible ray has not hitherto been developed. As a result, reduction of the maximum density and an unfavorable change of the halftone dot area tend to occur in the photomechanical process.

Furthermore, silver chlorobromide rather than silver chloride, and more particularly silver bromide are preferably used for providing the reversal properties, especially the Dmin of a direct reversal emulsion. As a result, the sensitivity of the emulsion is shifted to a longer wavelength region such that it is necessary to use a large amount of dyes to provide protection under a bright safelight.

Under these circumstances, dyes capable of absorbing a UV ray and a visible ray are added to the hydrophilic colloid layers arranged farther from the support than the light-sensitive silver halide emulsion layers in order to provide protection to a safelight. Where these dyes act as a filter layer, it is necessary that such a filter layer is selectively colored and that the other layers are substantially not colored. Particularly, if the emulsion layers also are substantially colored, the photographic properties of the emulsion layers are adversely affected, and the effect of the filter layer is also reduced. More particularly, under these circumstances, a pre-fogged emulsion exhibits an increased Dmin upon storage over a long period of time, and the spreading and chalking properties in a dot to dot work field and the reduction of an outline type property are also adversely affected.

A known method for solving these problems is to localize an acidic dye having a sulfo group or a carboxyl group in a specific layer with a mordant. Mordants typically used for this purpose include the polymers of ethylenically unsaturated compounds having a dialkylaminoalkyl ester residue as described in British Patent 685,474; the reaction products of polyvinylalkyl ketone and aminoguanidine as described in British Patent 850,281; and vinylpyridine polymers and vinylpyridinium cation polymers as described in U.S. Pat. Nos. 2,548,564, 2,484,430, 3,148,061, and 3,756,814. In these patents, cationic polymer mordants having a secondary or tertiary amino group, a nitrogen-containing heterocyclic group and a quaternary cationic group thereof are used such that the above noted acidic dyes are efficiently mordanted.

In these mordants, the above noted acidic dyes tend to diffuse to other layers, and in order to prevent the diffusion, the use of a large quantity of the mordant has been considered. However, the diffusion is not be completely prevented and also the thickness of the layers containing the mordants is increased, which in turn results in new problems originating therefrom.

Furthermore, in a light-sensitive material for printing plate-making, the procedure of reduction using a reducer is usually carried out. In this technique, a water-soluble iron complex is contained as a reduction cutting agent in the reducer, and the above described cationic mordants electrostatically combine with the iron complex to disadvantageously generate yellow stain.

Furthermore, other known means for fixing the dyes in a specific layer of the photographic light-sensitive material include adding the dyes as a dispersed solid body as disclosed in JP-A-56-12639 (the term "JP-A" as used herein means an unexamined published Japanese patent application), JP-A-55-155350, JP-A-55-155351, JP-A-52-92716, JP-A-59-193447, JP-A-61-198148, JP-A-63-197943, JP-A-63-27838, and JP-A-64-40827, European Patent 0015601B1 and 0276566A1, and International Application Publication 88/04794. However, the effect of this technique on a light-sensitive material containing a pre-fogged emulsion has not been reported in the literature.

Pre-fogged emulsions containing transition metals together with silver chloride or silver chlorobromide are described in JP-A-63-75739, JP-A-63-75738, JP-A-2-20852, JP-A-2-20855, JP-A-2-264938, JP-A-2-275940, and JP-A-2-301746, and European Patent 300631.

SUMMARY OF THE INVENTION

A first object of the present invention is to provide a direct positive type silver halide photographic light-sensitive material which can be handled in a bright room from which UV rays are excluded, and which is suitable for spreading and chalking properties and the preparation of an outline type.

A second object of the present invention is to provide a direct positive type silver halide photographic light-sensitive material capable of providing an image having a low minimum density (Dmin).

The third object of the present invention is to provide a direct positive type silver halide photographic light-sensitive material capable of providing an image having excellent tone reproducibility.

The above objects of the present invention have been achieved by providing a direct positive type silver halide photographic light-sensitive material comprising a support having thereon at least one pre-fogged light-sensitive silver halide emulsion layer containing fogged silver halide grains and at least one light-insensitive hydrophilic colloid layer provided farther from the support than the light-sensitive silver halide emulsion layer, wherein the light-insensitive hydrophilic colloid layer contains a dye dispersed therein in the form of microcrystalline particles.

BRIEF DESCRIPTION OF THE DRAWING

In the accompanying drawing.

THE DETAILED DESCRIPTION OF THE INVENTION

Figure 1:
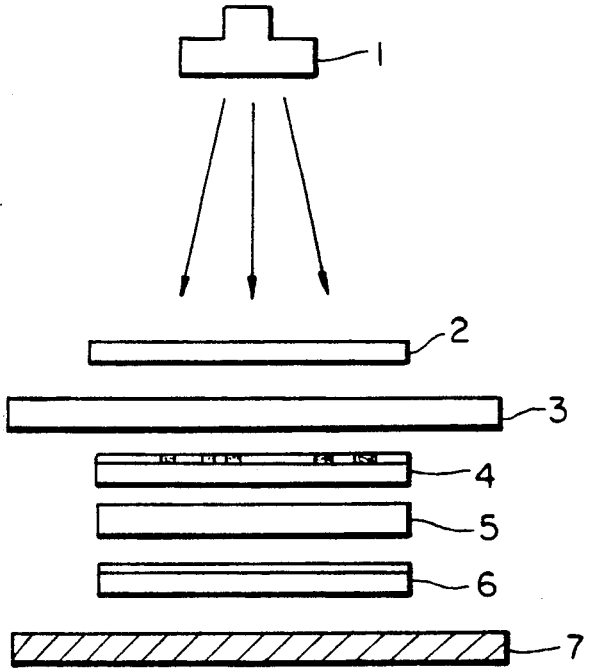
FIG. 1 is a model view showing the exposure method for evaluating spreading and chalking properties as described in Example 1.

The dye for use in the present invention which is dispersed in the form of microcrystalline particles includes the compounds described in Tables I to X of International Patent WO88/04794, the compounds represented by following Formulae (I) to (VII) and other compounds:

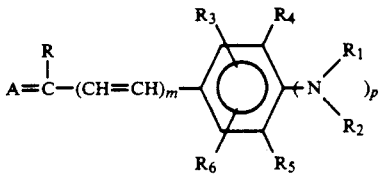

(I)

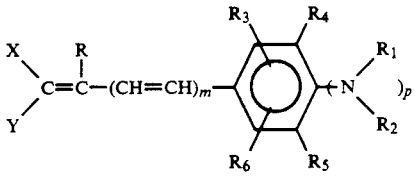

(II)

$A{=}L_1{-}(L_2{=}L_3)_n{-}A'$ (III)

$A{=}(L_1{-}L_2)_{2-q}{=}B$ (IV)

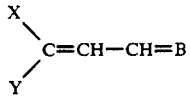

(V)

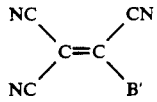

(VI)

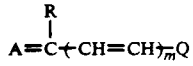

(VII)

wherein A and A' may be the same or different and each represents an acidic nucleus; B represents a basic nucleus; X and Y may be the same or different and each represents an electron-attractive group; R represents a hydrogen atom or an alkyl group; $R_1$ and $R_2$ each represent an alkyl group, an aryl group, an acyl group, or a sulfonyl group, provided that $R_1$ and $R_2$ may be combined with each other to form a 5 or 6-membered ring; $R_3$ and $R_6$ each represent a hydrogen atom, a hydroxy group, a carboxyl group, an alkyl group, an alkoxy group, or a halogen atom; $R_4$ and $R_5$ each represent a hydrogen atom, or $R_4$ and $R_5$ each represent a group of non-metallic atoms necessary to form a 5 or 6-membered ring by combining $R_1$ and $R_4$ or $R_2$ and $R_5$; $L_1$, $L_2$ and $L_3$ each represent a methine group; m represents 0 or 1; n and q each represent 0, 1 or 2; p represents 0 or 1, provided that when p is 0, $R_3$ represents a hydroxy group or a carboxyl group and $R_4$ and $R_5$ represent a hydrogen atom; B' represents a carboxyl group, a sulfamoyl group, or a heterocyclic group having a sulfonamide group; and Q represents a heterocyclic group.

In the above definitions, the alkyl group preferably has 1 to 8 carbon atoms and the specific examples thereof include a methyl group, an ethyl group, an isopropyl group, a butyl group, a hexyl group and an octyl group; the specific examples of the aryl group include a phenyl group and a naphthyl group; the acyl group preferably has 1 to 9 carbon atoms and the specific examples thereof include an acetyl group and a benzoyl group; the sulfonyl group preferably has 1 to 9 carbon atoms and the specific examples thereof include a methanesulfonyl group, and a benzenesulfonyl group; and the alkoxy group preferably has 1 to 8 carbon atoms and the specific examples thereof include a methoxy group, an ethoxy group and a butoxy group. Further, the heterocyclic group comprises one or more hetero atoms such as nitrogen or sulfur.

The compounds represented by formulae (I) to (VII) have in each molecule thereof at least one dissociative group having a pKa value of 4 to 11 (e.g., a carboxyl group, a sulfonamide group, a sulfocarbonyl group) in a mixed solution of water and ethanol in a 1:1 ratio by volume.

More specifically, the dyes for dispersing in the form of microcrystalline particles for use in the present invention are the compounds described in International Patent WO88/04794, European Patent EP 0274723A1, 276,566, and 299,435, JP-A-52-92716, JP-A-55-155350, JP-A-55-155351, JP-A-61-205934, and JP-A-48-68623, U.S. Pat. Nos. 2,527,583, 3,486,897, 3,746,539, 3,933,798, 4,130,429, and 4,040,841, JP-A-2-282244, JP-A-3-7931, and JP-A-3-167546, which patents are incorporated herein by reference.

The dispersing methods for use in the present invention are also described in the above patents, including, the method in which the dyes are mechanically dispersed in the form of a solid body in water together with a suitable dispersant with a ball mill, a sand mill or a colloid mill; the method in which the dyes are dispersed in the form of a solid body by coating the salts of the dissociated dyes, followed by further coating acidic gelatin thereon; and the method in which the dyes are dissolved in an alkaline solution and then the pH of the solution is lowered in the presence of a protective colloid such as gelatin to obtain fine solid precipitates. Furthermore, a dispersed solid body of a dye may be obtained by dissolving the dye in a suitable solvent and then adding thereto a solvent in which the dye is sparingly soluble.

The microcrystalline particulate dyes have an average particle size of 10 μm or less, preferably 1 μm or less, and more preferably 0.5 μm or less. Further, the average particle size may be 0.1 μm or less. The lower limit is 0.005 μm.

Preferred dyes for use in the present invention have a maximum absorption in the range of from 300 to 500 nm. Useful examples of the dyes are shown below, but the present invention should not be construed as being limited thereto:

I-1
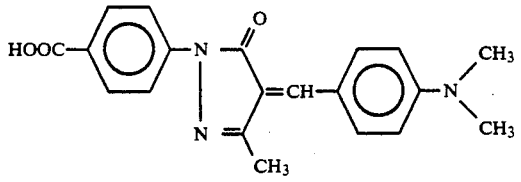
I-2
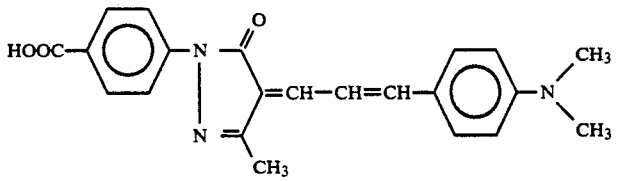
I-3
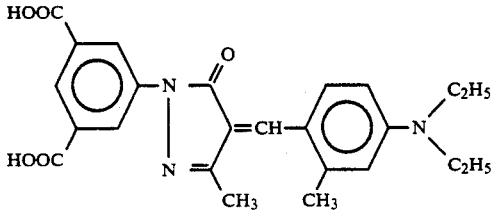
I-4
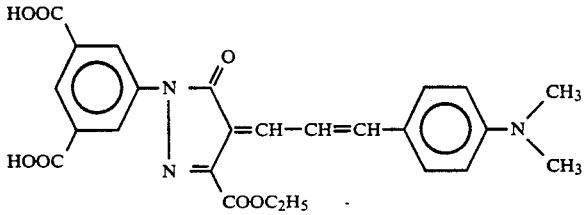
I-5
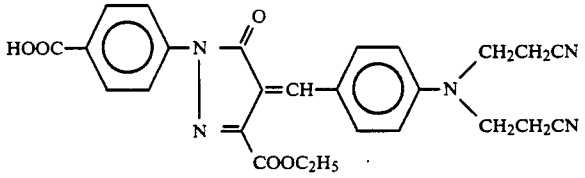
I-6
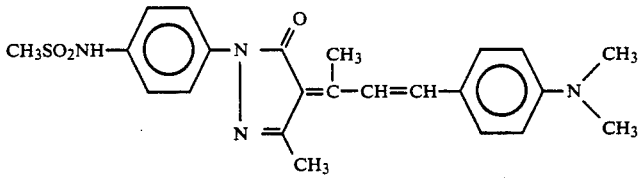
I-7
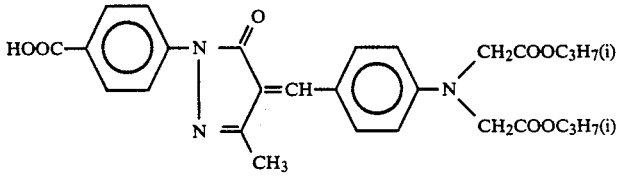
I-8
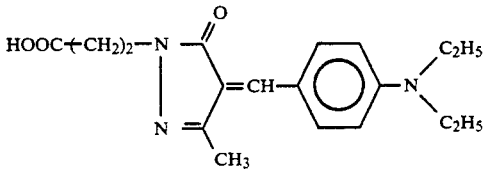

-continued
I-9
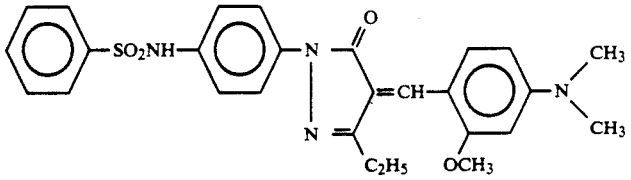
I-10
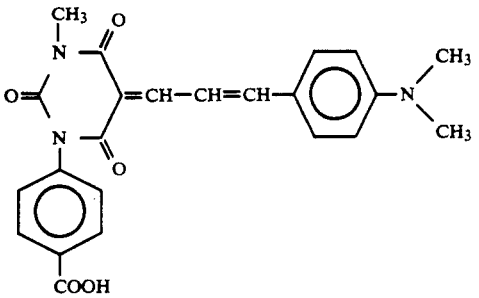
I-11
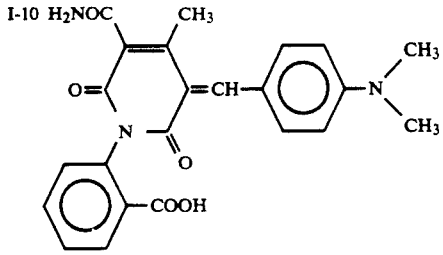
I-12
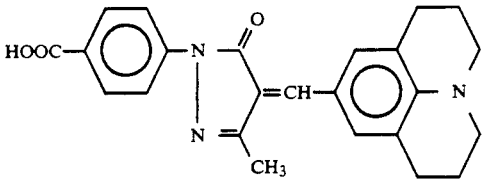
I-13
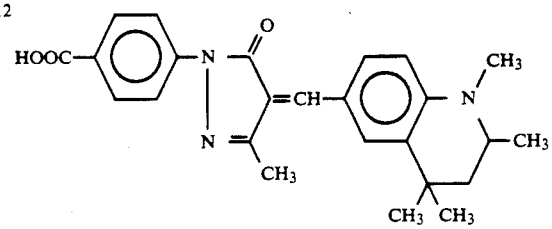
I-14
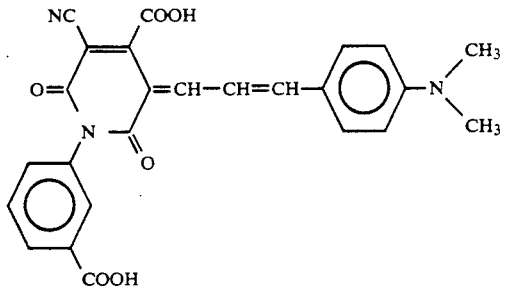
I-15
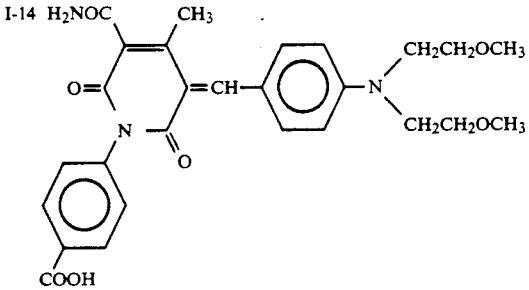
I-16
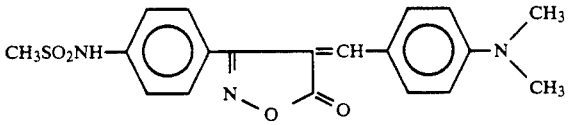
I-17
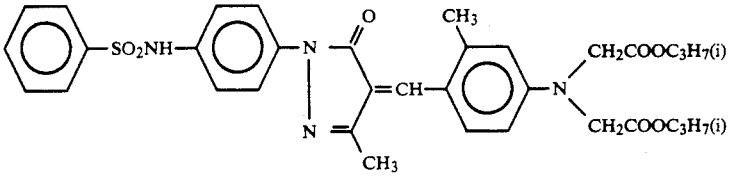
I-18
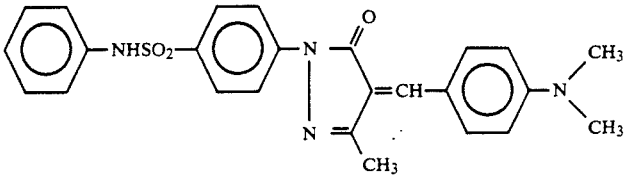

-continued
I-19
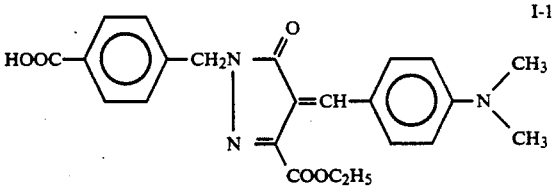
I-20
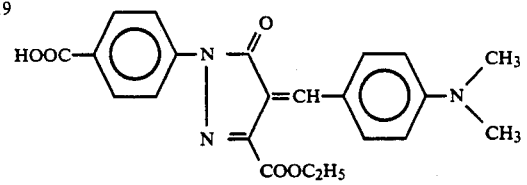
II-1
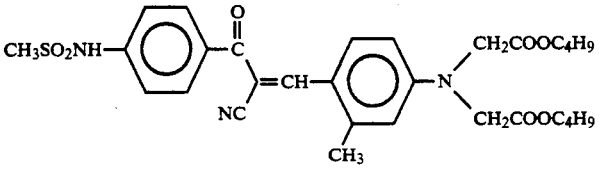
II-2
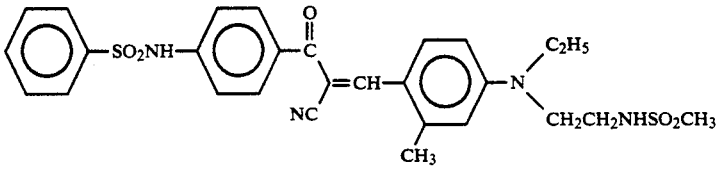
II-3
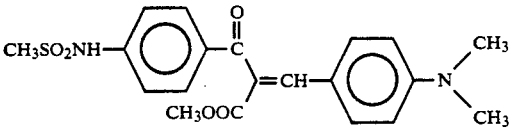
II-4
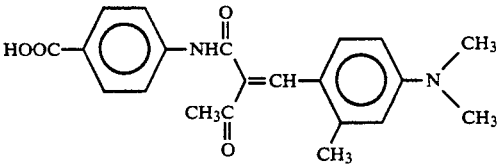
II-5
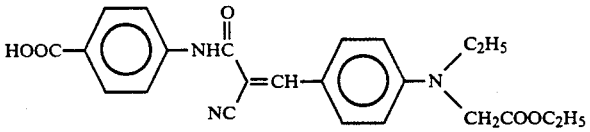
II-6
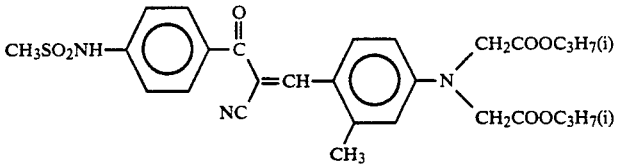
III-1
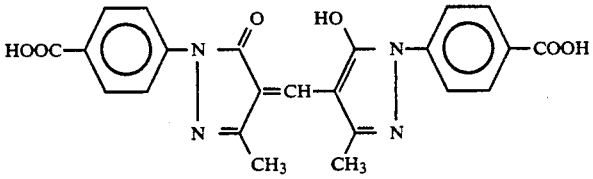
III-2
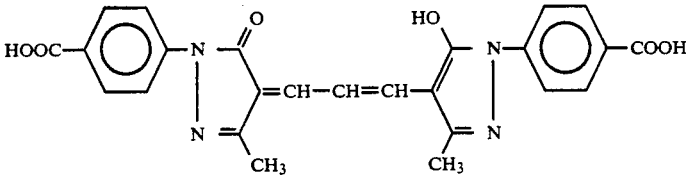

-continued
III-3
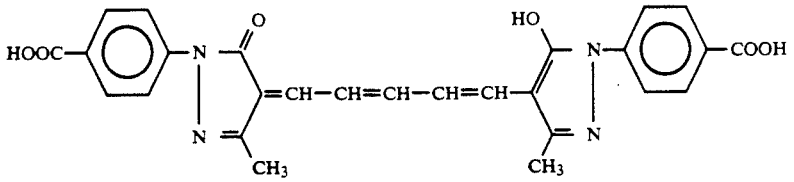
III-4
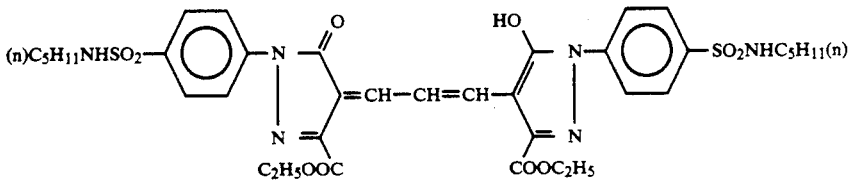
III-5
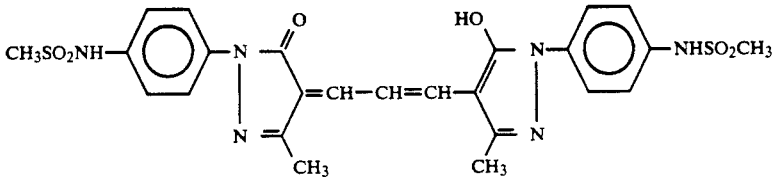
III-6
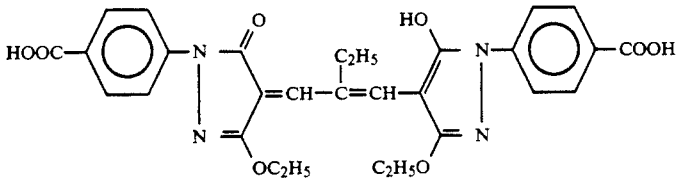
III-7
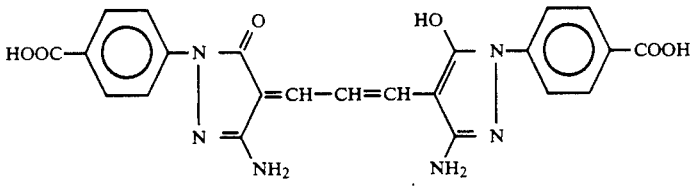
III-8
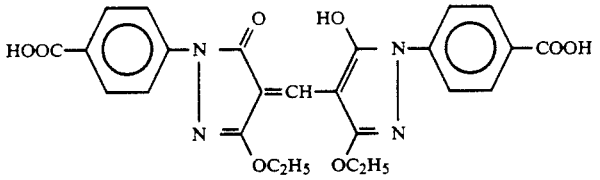
III-9
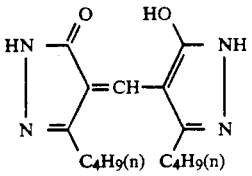
III-10
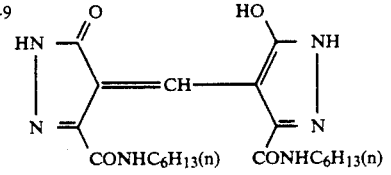
IV-1
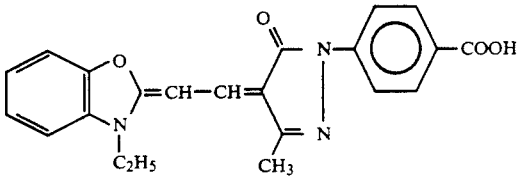
IV-2
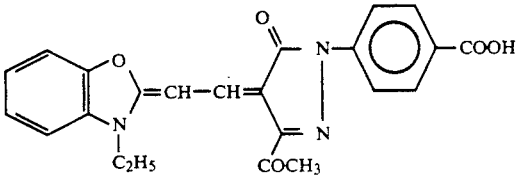

-continued
IV-3
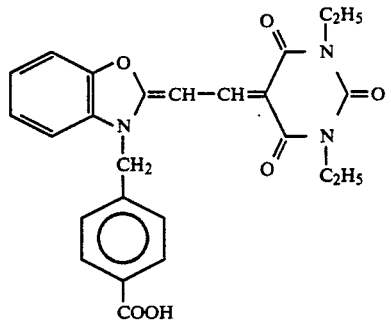
IV-4
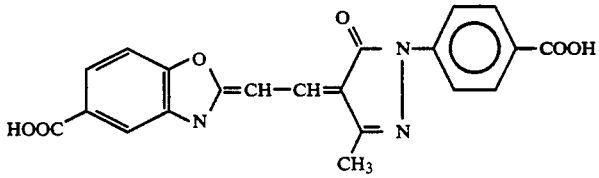
IV-5
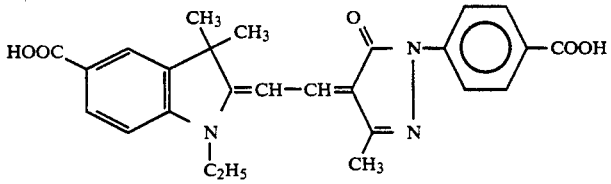
IV-6
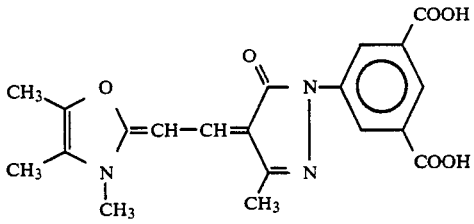
IV-7
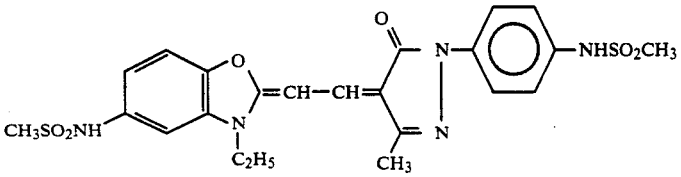
IV-8
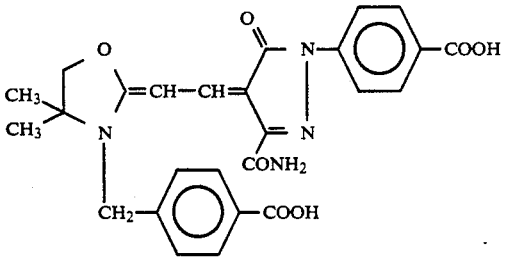
IV-9
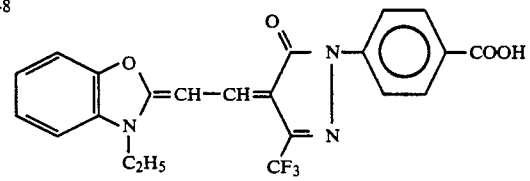
V-1
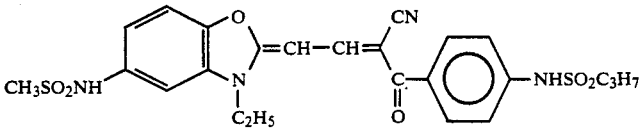

-continued
V-2
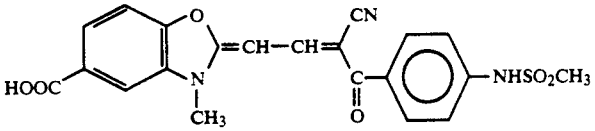
V-3
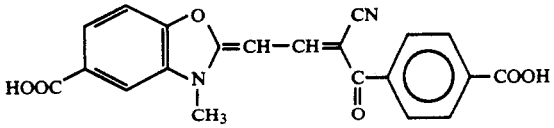
V-4
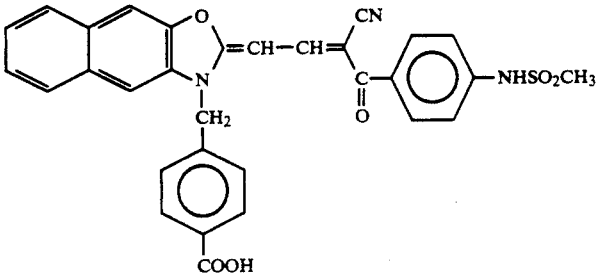
V-5
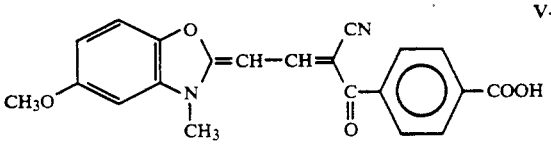
V-6
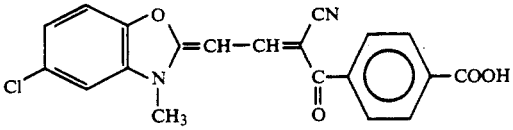
V-7
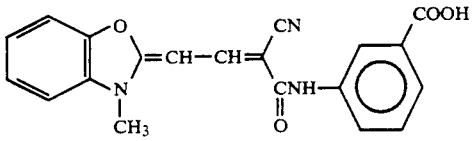
VI-1
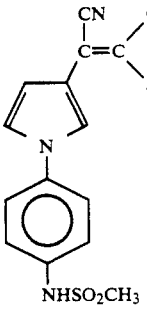
VI-2
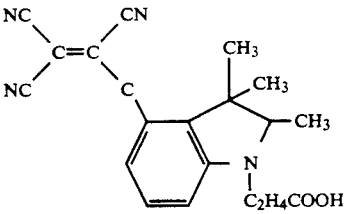
VI-3
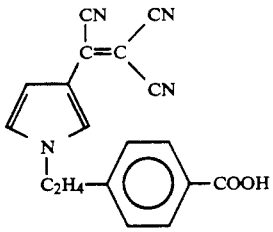
VI-4
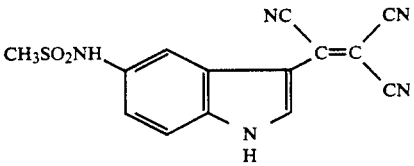
VI-5
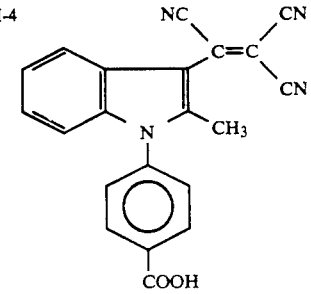

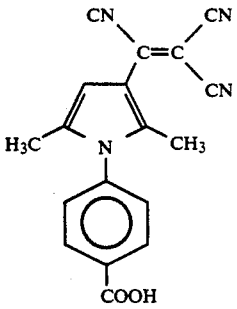

-continued

VI-6

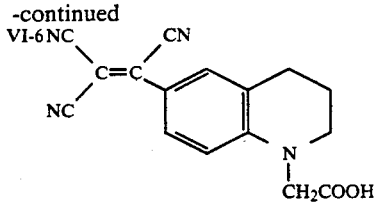

VI-7

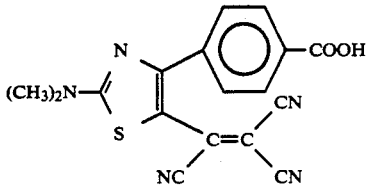

VI-8

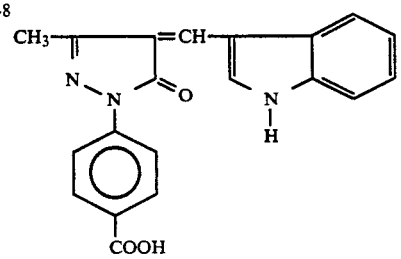

VII-1

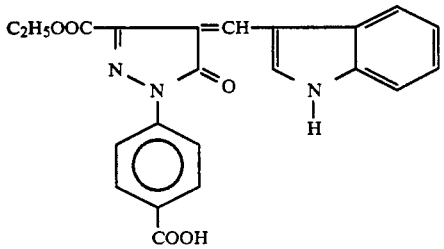

VII-2

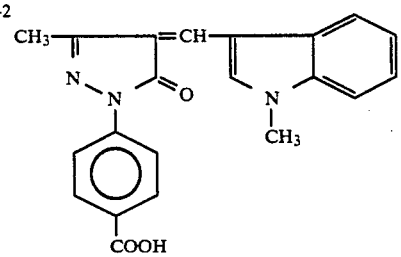

VII-3

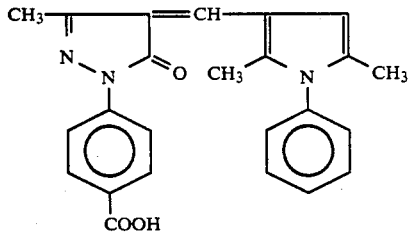

VII-4

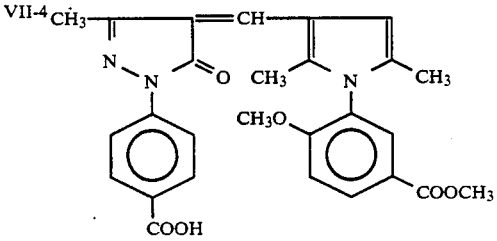

VII-5

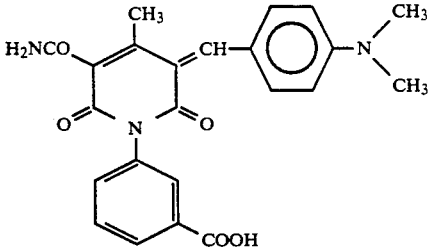

VII-6

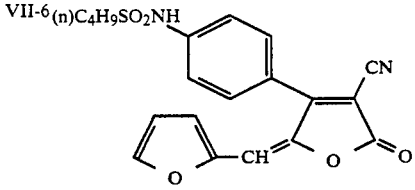

VII-7

The silver halide light-sensitive material of the present invention containing a dye dispersed in the form of microcrystalline particles can be handled in a bright room from which UV rays of 400 nm or less are excluded. The dye is added to a light-insensitive layer farther from a support than a light-sensitive silver halide emulsion layer for the purpose of improving the spreading, chalking and outline type properties. The coated amount of the dye is preferably 10 to 500 mg/m$^2$, particularly preferably 50 to 300 mg/m$^2$.

The light-insensitive layer comprises gelatin and is used as a protective layer, etc. Further, a matting agent, a lubricant, and a surfactant may be added to the light-insensitive layer. The layer thickness is generally 0.1 to 3 $\mu$m, preferably 0.5 to 2 $\mu$m.

The dyes for use in the present invention are readily synthesized by the methods described in International Patent WO88/04794, European Patent EP 0274723A1, 276,566, and 299,435, JP-A-52-92716, JP-A-55-155350, JP-A-55-155351, JP-A-61-205934, and JP-A-48-68623, U.S. Pat. Nos. 2,527,583, 3,486,897, 3,746,539, 3,933,798, 4,130,429, and 4,040,841, JP-A-2-282244, JP-A-3-7931 and JP-A-3-167546.

In the direct positive silver halide photographic light-sensitive material of the present invention, the dye dispersed in the form of microcrystalline particles and/or a water-soluble dye can also be added to a silver halide emulsion layer as long as the spreading, chalking and outline type properties are not deteriorated for the purpose of improving tone reproducibility. A water-soluble dye can also be added to a hydrophilic colloid layer other than an emulsion layer. The preferred addition amount thereof is in the range in which the sensitivity reduction caused by addition of the dye does not exceed 0.2 in log E. Generally, the addition amount is 5 to 100 $mg/m^2$.

Water-soluble dyes for use in the present invention have a main absorption in a visible wave-length region of the intrinsic light-sensitive wavelength of the silver halide emulsion that is selected. Among them, preferred are dyes having λ max ranging from 350 to 600 nm. There are no specific limits as to the chemical structure of the dyes, which dyes may include an oxonol dye, a hemioxonol dye, a merocyanine dye, a cyanine dye, and an azo dye.

For example, useful dyes include the pyrazolone dyes described in JP-B-58-12576 (the term "JP-B" as used herein means an examined Japanese patent publication), the pyrazolone oxonol dyes described in U.S. Pat. No. 2,274,782, the diarylazo dyes described in U.S. Pat. No. 2,956,879, the styryl dyes and butadienyl dyes described in U.S. Pat. Nos. 3,423,207 and 3,384,487, the merocyanine dyes described in U.S. Pat. Nos. 2,527,583, the merocyanine dyes and oxonol dyes described in U.S. Pat. Nos. 3,486,897, 3,652,284, and 3,718,472, the enaminohemioxonol dyes described in U.S. Pat. No. 3,976,661, and the dyes described in British Patent 584,609 and 1,177,429, JP-A- 48-85130, JP-A-49-99620, and JP-A-49-114420, U.S. Pat. Nos. 2,533,472, 3,148,187, 3,177,078, 3,247,127, 3,540,887, 3,575,704, and 3,653,905.

The silver halide composition for use in the present invention is not particularly restricted, but is preferably silver bromide or silver chlorobromide. Particularly preferred is silver chlorobromide having a silver chloride content of 70 mol % or more, preferably 90 mol % or more.

The silver halide grain size thereof is preferably 0.10 to 1.0 μm, more preferably 0.15 to 0.40 μm.

The silver halide grains contained in a photographic emulsion preferably have a regular form such as a cube and octahedron. The silver halide content in the light-sensitive material of the present invention is in the range of generally 1 to 4 $g/m^2$, preferably 2 to 3 $g/m^2$.

The grain size distribution is preferably narrow. In particular, a mono-dispersed emulsion in which 90%, preferably 95% of all of the grains fall within ±40 of the average grain size is preferred.

The silver halide emulsions for use in the direct positive type silver halide light-sensitive material of the present invention are of two types; namely, a first emulsion comprising silver halide grains which contain a nucleus capable of trapping free electrons and having a pre-fogged surface, where the salts of the VIII group metals are preferably used as the free electron-trapping nucleus; and a second emulsion comprising silver halide grains which do not have a free electron-trapping nucleus and has a chemically fogged surface. This emulsion itself provides no direct positive image, but can provide a direct positive image when used together with an organic desensitizer.

There can be used as the emulsion having a free electron-trapping nucleus the emulsions described in, for example, JP-B-43-4125, JP-B-43-29405, U.S. Pat. Nos. 2,401,051, 2,976,149, and 3,023,102, British Patents 707,704 and 1,097,999, French Patents 1,520,824 and 1,520,817, and Belgian Patents 713,272, 721,567, and 681,768.

There can be used as the emulsion not having a free electron-trapping nucleus the emulsions described in, for example, British Patents 1,186,717, 1,186,714, and 1,186,716, and U.S. Pat. Nos. 3,501,306, 3,501,307, 3,501,310, 3,531,288, and 1,520,817.

An emulsion having an electron-trapping nucleus in the silver halide grains is preferred for use in the present invention. The electron-trapping nucleus can be introduced into the grains by incorporating therein a transition metal, preferably in the form of a coordination complex, selected from the elements of groups V to VIII of the Periodic Table in an amount of $10^{-7}$ to $10^{-3}$ mole, preferably $10^{-6}$ to $10^{-4}$ mole per mole of silver halide.

The transition metal coordination complex preferred for achieving the objects of the present invention is a hexa-ligand complex represented by the following formula:

$$[M(NY)L_5]^m$$

wherein M is a transition metal selected from the elements of groups V to X of the Periodic Table; L is a bridging ligand and may be replaced with one NY; Y is oxygen or sulfur; and m is 0, −1, −2 or −3.

Preferred examples of L are nitrosyl and thionitrosyl bridging ligands, in addition to a halide ligand (fluoride, chloride, bromide and iodide), a cyanide ligand, a cyanate ligand, a thiocyanate ligand, a selenocyanate ligand, a tellurocyanate ligand, an azide ligand, and an aquo ligand. Where the aquo ligand is present, one or two of the ligand positions are occupied preferably thereby.

Particularly preferred examples of M are rhodium, ruthenium, rhenium, osmium and iridium.

Useful examples of the transition metal coordination complex are shown below:

1. $[Ru(NO)Cl_5]^{-2}$
2. $[Ru(NO)_2Cl_4]^{-1}$
3. $[Ru(NO)(H_2O)Cl_4]^{-1}$
4. $[Rh(NO)Cl_5]^{-2}$
5. $[Re(NO)Cl_5]^{-2}$
6. $[Re(NO)CN_5]^{-2}$
7. $[Re(NO)ClCN_4]^{-2}$
8. $[Rh(NO)_2Cl_4]^{-1}$
9. $[Rh(NO)(H_2O)Cl_4]^{-1}$
10. $[Ru(NO)CN_5]^{-2}$
11. $[Ru(NO)Br_5]^{-2}$
12. $[Rh(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)Cl_4(SeCN)]^{-2}$
19. $[Os(NS)Cl(SCN)_4]^{-2}$
20. $[Ir(NO)Cl_5]^{-2}$

The above metal complexes can be incorporated into the silver halide grains prior to or during the step of silver halide grain formation.

The timing of the addition of the metal complex may be such that the metal complex is evenly distributed throughout the silver halide grains. Preferably, the metal complex is introduced such that it is present in a core portion of the silver halide grains.

The direct positive silver halide emulsion of the present invention may be fogged by known methods in which the emulsion is subjected to a treatment with light or a chemical treatment to carry out fogging. Such fogging can be carried out by many methods such as continuing chemical sensitization until fog is generated. Particularly excellent results can be obtained, for example, by the method described in *Science Et Industrie Photographique,* 28, (January, 1957), pp. 57 to 65. The silver halide grains can be fogged by strong light, reducing foggants such as thiourea dioxide and stannous chloride, or gold or noble metal compounds. The silver halide grains can be fogged as well with a combination of a reducing agent and a gold compound or a compound of an electrically more positive metal than silver, such as rhodium, platinum and iridium.

The direct positive photographic emulsion preferably comprises silver halide grains fogged with both of a reducing foggant and a gold foggant to provide an increase in sensitivity and a decrease in Dmin. Such a combination is disclosed in U.S. Pat. Nos. 3,501,307, 3,501,306, 3,531,288, etc. and provides specially fogged silver halide grains characterized in that the fog is rapidly reversed by chemical bleaching where each of a reducing foggant and a gold foggant are used in low concentration.

It is known that one equivalent of a reducing agent reduces one equivalent of silver of silver halide. Far less reducing foggant than one equivalent (per equivalent of silver halide) is used to obtain the fogged silver halide grains characterized in that the fog is rapidly reversed by chemical bleaching; namely, a reducing foggant of 0.06 milliequivalent or less is used to fog one equivalent of silver halide. In the present invention, the reducing foggant is generally used in an amount of from about 0.0005 to 0.06 milliequivalent, preferably about 0.001 to 0.03 milliequivalent per mole of silver halide for fogging the silver halide grains. The use of a reducing foggant of an increased concentration leads to a loss of a photographic speed to a large extent.

Examples of the reducing foggant for use in the present invention include hydrazines, phosphonium salts, for example, tetra(hydroxymethyl) phosphonium chloride, and thiourea dioxide, each of which is described in U.S. Pat. Nos. 3,062,651 and 2,983,609; stannous salts such as stannous chloride (in reference to U.S. Pat. No. 2,487,850); polyamines, for example, diethylenetriamine (in reference to U.S. Pat. No. 2,519,698); polyamines, for example, spermine (in reference to U.S. Pat. No. 2,521,925); and bis($\beta$-aminoethyl) sulfide and the water-soluble salts thereof (in reference to U.S. Pat. No. 2,521,926).

The gold foggant for use in the present invention may a gold salt conventionally used for fogging photographic silver halide grains without particular limitation such as those described, for example, in U.S. Pat. Nos. 2,399,083 and 2,642,361. Examples thereof are potassium chloraurite, potassium aurithiocyanate, potassium chloroaurate, auricrichloride, aurosulfobenzo-thiazole, and methchloride.

The addition amount of the gold foggant for use in the present invention can vary over a wide range, but is generally in the range of from about 0.001 to 0.01 millimole per mole of silver halide. Potassium chloraurate is a particularly preferred gold foggant and is added in an amount of from about 5 mg or less, preferably about 0.5 to 4 mg per mole of silver halide. Where the gold foggant is used in combination with a reducing foggant, the gold foggant preferably constitutes the major part of the combination of foggants. In general, the molar ratio of the gold foggant to the reducing foggant is generally about 1:3 to 20:1, and preferably about 2:1 to 20:1.

The silver halide grains preferably are first fogged with the reducing foggant, followed by fogging with the gold foggant. However, it is possible to reverse the above order with respect to fogging, or the reducing foggant and gold foggant may be used simultaneously.

In the present invention, the silver halide grains can be fogged prior to coating or after coating. The conditions for fogging the silver halide grains vary over a wide range; in general, the pH is about 5 to 7, the pAg is about 7 to 9, and the temperature is about 40° to 100° C., preferably about 50° to 70° C.

The direct positive silver halide emulsion for use in the present invention can contain one or more types of organic desensitizers capable of adsorbing onto the surface of the silver halide grains. Preferred organic desensitizers are the compounds represented by formulae (I), (II) and (III) as described in JP-A-63-75739.

Useful examples of the organic desensitizer are set forth below, but the present invention should not be construed as being limited thereto.

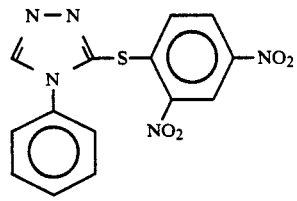

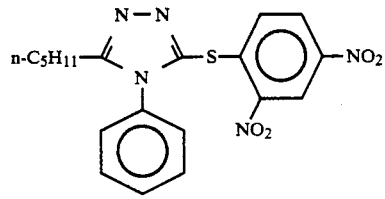

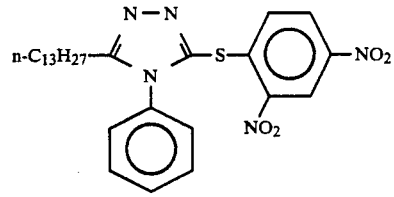

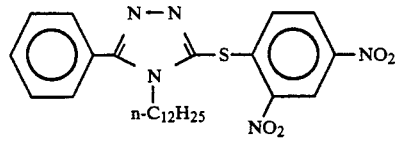

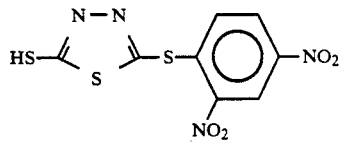

-continued
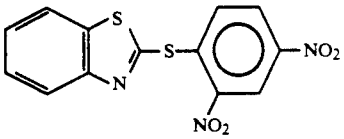
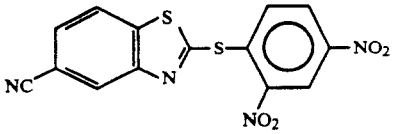
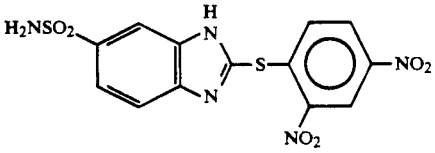
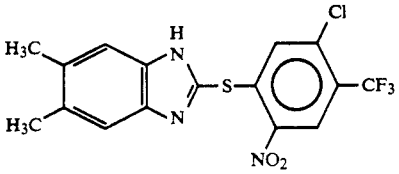
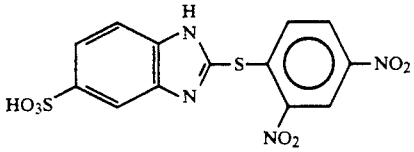
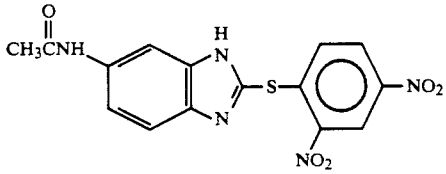
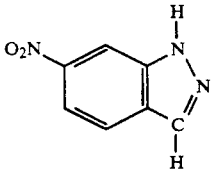
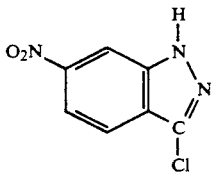
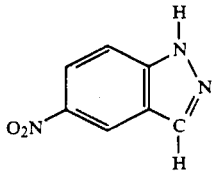
-continued
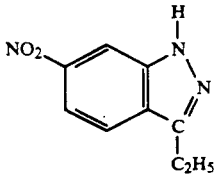
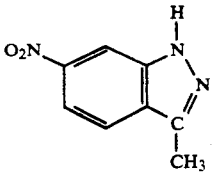
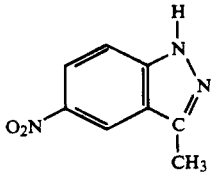
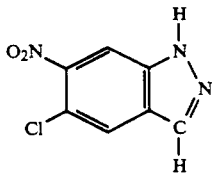
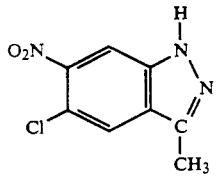
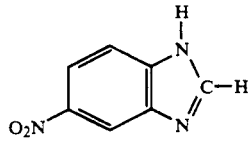
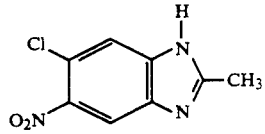
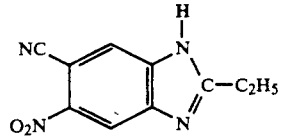
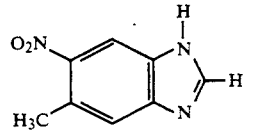

-continued

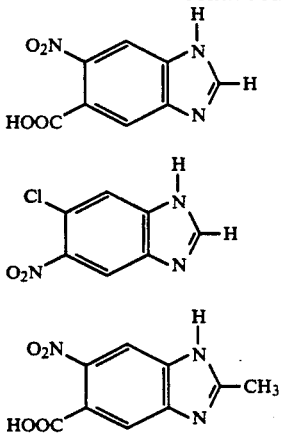

Other organic desensitizers for use in the present invention are, for example, a dimethinecyanine dye containing a 2-(nitro-substituted phenyl)-indole nucleus, a bis-(1-alkyl-2-phenyl)-indole-3-trimethinecyanine dye, a cyanine dye containing an aromatic-substituted-indole nucleus, an imidazoquinoxaline dye, an asymmetric cyanine dye containing a carbazole nucleus, a trimethinecyanine dye containing a 2-aromatic-substituted indole nucleus, a cyanine dye containing a 2,3,3-trialkyl-3H-nitroindole nucleus, a cyanine dye containing a complex fused-pyrimidinedione nucleus, a quaternarized merocyanine dye containing a 2-isoxazoline-5-one nucleus, a 2-pyrazoline-5-one nucleus or a complex fusedpyrimidinedione nucleus, a cyanine dye containing a 2-allylimino (or alkylimino)-4-allyl (or alkyl)-3-thiazoline nucleus, a merocyanine quaternary ammonium salt dye having 3-allyl-amino or 3-lower fatty acid amide-substituted 2-pyrazoline-5-one, a pyrylium, thiapyrylium and selenapyrylium dyes in the form of a salt, a cyanine dye containing a nitrosubstituted 2-aryl-indole nucleus, a pyridinium salt dye, a cyanine dye containing a pyrrole nucleus bonded with a carbon atom at a 2-position, a 1,2-diaryltrimethineindole dye, a cyanine dye containing a 4-pyrazole nucleus, a polymethine dye containing an imidazole nucleus, a dimethinecyanine dye containing a 2-phenyl-substituted indole nucleus, a trimethinecyanine dye comprising two indole nuclei, a cyanine dye containing a 1-cyanoalkyl-2-arylindole nucleus, cyanine and merocyanine dyes containing two nucleus having desensitizing substituents such as a nitro group, a cyanine dye containing a 1-alkyl-2-phenyl-substituted indole nucleus, a cyanine dye containing a 1-alkoxy-2-arylindole nucleus, a cyanine dye containing an imidazo (4,5,6) quinoxaline nucleus, a dye containing a cyclo-heptanetolylene ring, a dimethinecyanine dye containing an indole nucleus, a cyanine dye containing a pyrazolo (1, 5-a) benzimidazole nucleus, a cyanine dye containing a pyrazolo (5, 1-b) quinazolone nucleus, a dimethinecyanine dye containing a pyrrolo (2, 3-b) pyridine nucleus, a cyanine dye containing a pyrrole nucleus, a dye containing a pyrrolo (2, 1-b) thiazole nucleus, a cyanine dye containing an indole or indolenine nucleus having a benzoyl or phenylsulfonyl substituent, the nitrostyryl compounds described in U.S. Pat. No. 2,669,515, Pinacryptol Yellow, 5-metanitrobenzylidene rhodanine, the bis-pyridinium compounds described in JP-B-48-13059, and the phenazine compounds described in JP-B-47-8746.

The addition amount of the organic desensitizer for use in the present invention is generally in the range of from $1\times10^{-6}$ to $5\times10^{-1}$ mole, preferably $1\times10^{-5}$ to $2\times10^{-2}$ mole per mole of silver halide.

Various other generally employed photographic additives can be incorporated into the direct positive silver halide photographic light-sensitive material of the present invention, including, e.g., stabilizers, triazoles, azaindenes, quaternary benzothiazolium compounds, mercapto compounds, or water-soluble inorganic salts of cadmium, cobalt, nickel, manganese, gold, thallium, and zinc.

The light-sensitive material of the present invention may contain a hardener (e.g., aldehydes such as formalin, glyoxal and mucochloric acid, S-triazines, epoxies, azilidines, and vinylsulfonic acid); as a coating aid (e.g., saponin, poly-sodium alkylenesulfonate, polyethylene glycol lauryl or oleyl monoether, amylized alkyltaurine, and fluorinated compounds); a color coupler; a whitening agent; a UV absorber; a preservative; a matting agent; and an anti-static agent as required.

The photographic emulsion layers and other hydrophilic colloid layers of the light-sensitive material of the present invention may contain various surfactants for use as a coating aid and an anti-static agent, for improvement in sliding, emulsification-dispersion, prevention of sticking, and improvement in the photographic characteristics (for example, acceleration of development, harder gradation and sensitization).

Examples thereof include nonionic surfactants such as saponin (steroid type), alkylene oxide derivatives (for example, polyethylene glycol, a polyethylene glycol/polypropyrene glycol condensation product, polyethylene glycol alkylethers, polyethylene glycol alkyl aryl ethers, polyethylene glycol esters, polyethylene glycol sorbitan esters, polyalkylene glycol alkylamines or amides, and adducts of silicone and polyethylene oxide), glycidol derivatives (for example, alkenylsuccinic acid polyglycerides and alkylphenol polyglycerides), fatty acid esters of polyhydric alcohol, and alkyl esters of sucrose; anionic surfactants having acid groups such as a carboxyl group, a sulfo group, a phospho group, a sulfuric acid ester group and a phosphoric acid ester group, such as alkylcarbonic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkyl polyoxyethylenealkylphenyl ethers, and polyoxyethylene alkylphosphoric acid esters; amphoteric surfactants such as amino acids, aminoalkylsulfonic acid esters, aminoalkylsulfonic acid or -phosphoric acid esters, alkylbetaines, and amine oxides; and cationic surfactants such as alkylamine salts, aliphatic or aromatic quaternary ammonium salt, pyridiniums, heterocyclic quaternary ammonium salts such as imidazoliums, and aliphatic or heterocycle-containing phosphonium or sulfonium salts.

The surfactants particularly preferably used in the present invention are polyalkylene oxides having a molecular weight of 600 or more, as described in JP-B-58-9412.

The polyalkylene oxide compounds for use in the present invention include the condensation products of alkylene oxide having 2 to 4 carbon atoms, for example, ethylene oxide, propylene-1,2-oxide and butylene-1,2-oxide, preferably polyalkylene oxide consisting of at least 10 units of ethylene oxide, and the compounds having at least one active hydrogen atom, such as water, aliphatic alcohol, aromatic alcohol, fatty acid, organic amine, and a hexitol derivative, or block copolymers of two or more kinds of polyalkylene oxides. Examples of the poly-alkylene compounds for use in the present invention are:

polyalkylene glycols,
polyalkylene glycol alkyl ethers,
polyalkylene glycol aryl ethers,
polyalkylene glycol alkyl aryl ethers,
polyalkylene glycol esters,
polyalkylene glycol fatty acid amides,
polyalkylene glycol amines,
polyalkylene glycol block copolymers, and
polyalkylene glycol-grafted polymers.

The molecular weight of the polyalkylene compound is 600 or more.

Two or more kinds of polyalkylene oxides may be contained in the same molecule. In such case, the respective polyalkylene oxides may consist of a number of alkylene oxide units less than 10, but the total number of alkylene oxides units contained in the molecule must be at least 10. Where two or more polyalkylene oxides are contained in the same molecule, each of them may consist of different alkylene oxide units, for example, ethylene oxide and propylene oxide. The polyalkylene oxide compounds consist of 14 or more and up to 100 alkylene oxide units.

Examples of the polyalkylene oxide compounds for use in the present invention are shown below:

$HO(CH_2CH_2O)_{90}H$ $C_4H_9O(CH_2CH_2O)_{15}H$ $C_{12}H_{25}O(CH_2CH_2O)_{15}H$ $C_{18}H_{37}O(CH_2CH_2O)_{15}H$ $C_{18}H_{37}O(CH_2CH_2O)_{40}H$ $C_8H_{17}CH{=}CHC_8H_{16}O(CH_2CH_2O)_{15}H$

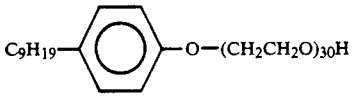

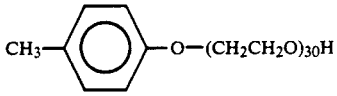

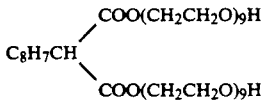

$C_{11}H_{23}CONH(CH_2CH_2O)_{15}H$

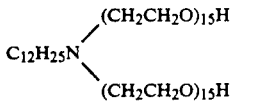

$C_{14}H_{29}N(CH_2)(CH_2CH_2O)_{24}H$

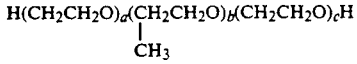

a + b + c = 50
b:a + c = 10:9

-continued

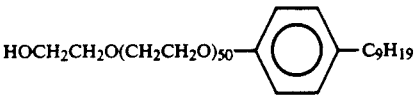

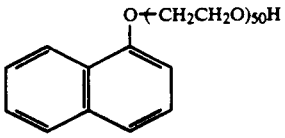

When a polyalkylene oxide compound is added to a silver halide emulsion, the polyalkylene oxide compound can be added to the emulsion as an aqueous solution of appropriate concentration, or as a solution of a low-boiling organic solvent miscible with water at a suitable time before coating, preferably after chemical ripening. The polyalkylene oxide compound may be added to a light-insensitive hydrophilic colloid layer, for example, an intermediate layer, a protective layer and a filter layer.

The addition amount of the polyalkylene oxide compound is in the range of generally 1 to 1,000 mg/m$^2$, preferably 5 to 200 mg/m$^2$.

In the photographic light-sensitive material of the present invention, a matting agent such as silica, magnesium oxide and polymethyl methacrylate can be incorporated into a photographic emulsion layer and other hydrophilic colloid layers for the purpose of preventing adhesion.

The photographic emulsions of the present invention can contain a dispersions of a water-insoluble or sparingly water-soluble synthetic polymer for improving dimensional stability. For example, there can be used alone or in combination, the polymers of alkyl (meth)acrylate, alkoxyalkyl (meth)acrylate, (meth)acrylamide, vinyl ester (for example, vinyl acetate), and acrylonitrile.

In the emulsion for use in the present invention, gelatin is mainly used as protective colloid, and in particular inert gelatin is advantageously used. Gelatin may be replaced by photographically inert gelatin derivatives (for example, phthalized gelatin) and water-soluble synthetic polymers, for example, polyvinyl acrylate, polyvinyl alcohol, and polyvinylpyrrolidone.

The support used in the light-sensitive material of the present invention is not particularly limited and includes suitable supports for photography, for example, glass and a film substrate such as cellulose acetate, cellulose acetate butyrate, and polyester (for example, polyethylene terephthalate).

The imagewise exposed light-sensitive material of the present invention can be developed in a lith type developing solution having a low sulfite ion concentration; a developing solution containing sulfite ion in an amount (in particular, 0.15 mole/liter or more) sufficient as a preservative; and a developing solution having pH of 9.5 or higher, in particular 10.5 to 12.3.

The developing agents for use in the present invention are not particularly limited, and include alone or in combination, for example, dihydroxybenzenes (for example, hydroquinone), 3-pyrazolidones (for example, 1-phenyl-3-pyrazolidone and 4,4-dimethyl-1-phenyl-3-pyrazolidone), and aminophenols (for example, N-methyl-p-aminophenol).

The developing solution may contain a pH buffer agent such as a sulfurous acid salt, carbonic acid salt, boric acid salt and phosphoric acid salt each of alkali metals, and a development inhibitor or an anti-foggant such as bromide, iodide, and an organic anti-foggant (particularly preferably, nitroindazoles or benzotriazoles). Furthermore, as required, the developing solution may contain a hard water softener, a dissolution aid, a toning agent, a development accelerator, a surface active agent (particularly preferably, the abovementioned polyalkylene oxides), a defoaming agent, a hardener, and an anti-silver stain agent for a film (for example, a 2-mercapto-benzimidazolesulfonic acid).

Specific examples of these additives are described in *Research Disclosure* 176, 17643.

The processing temperature is selected from the range of from 18° to 50° C. A temperature lower than 18° C. or higher than 50° C. may be applied.

A fixing solution having a conventional composition can be used. Useful fixing agents include organic sulfur compounds known to act as fixing agents, as well as a thiosulfuric acid salt and a thiocyanic acid salt. Furthermore, the fixing solution may contain a water-soluble aluminum salt as a hardener.

EXAMPLE 1

Emulsions A to D were prepared in the following manner:

Emulsion A:

A silver nitrate aqueous solution and a mixed aqueous solution of sodium chloride and potassium bromide were added simultaneously to a gelatin aqueous solution maintained at 50° C. in the presence of $(NH_4)_3RhCl_6$ in an amount of $2\times10^{-5}$ mole per mole of silver at a constant speed (potential 50 mV) for 30 minutes to prepare a monodispersed silver chlorobromide emulsion having an average grain size of 0.2 μm [Cl content: 95 mol %, coefficient of variation (=standard deviation of grain size/average grain size×100): 10%]. This emulsion was subjected to desalting by a flocculation method. After adding dispersion gelatin, thiourea dioxide of 1 mg per mole of silver and chloroauric acid of 0.6 mg per mole of silver were added, and the silver halide grains were ripened at 65° C. until the maximum performance was obtained to thereby generate fog, followed by adding the water-soluble desensitizer (a) ($5\times10^{-4}$ mole/mole Ag) having the formula given below as a fogterminator.

Water-soluble desensitizer (a)

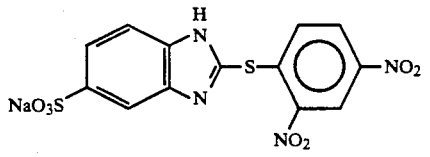

Emulsion B:

A silver chlorobromide emulsion having a Cl content of 80 mole % and a coefficient of variation of 11% was prepared in the same manner as Emulsion A.

Emulsion C:

A silver chlorobromide emulsion having a Cl content of 60 mole % and a coefficient of variation of 11% was prepared in the same manner as Emulsion A.

Emulsion D:

$(NH_4)_3Rh(H_2O)Cl_5$ in an amount of $3\times10^{-5}$ mole per mole of silver was added to a gelatin aqueous solution maintained at 70° C., and a silver nitrate aqueous solution and a sodium bromide aqueous solution were then added simultaneously at a constant speed for 80 minutes while maintaining a potential at +60 mV, whereby a monodispersed cubic silver bromide emulsion having an average grain size of 0.2 μm was prepared. This emulsion was subjected to desalting by a flocculation method, and then thiourea dioxide of 10 mg per mole of silver and chlorauric acid of 8 mg per mole of silver were added and ripened at 65° C. until the maximum performance was obtained to thereby generate fog.

Each of Emulsions (A) to (D) was divided and the following components were coated on a polyethylene terephthalate film. A lower protective layer was then coated simultaneously with an upper protective layer having the following compositions, to which the dye of the invention or a comparative compound was added as shown in Table 1, such that the respective samples had about the same sensitivity:

Emulsion layer:

| | |
|---|---|
| Emulsion shown in Table 1 (as an amount calculated as silver) | 3.2 g/m² |
| Desensitizer (b) | $1\times10^{-3}$ mol/mol of Ag |
| 10 wt % KBr aqueous solution (pAg: 9.0) | |
| Polyethyl acrylate latex | 500 mg/m² |
| Polyethylene oxide (c) | 10 mg/m² |
| 1,3-Divinylsulfonyl-2-propanol | 80 mg/m² |
| Sodium 2-hydroxy-4,6-dichloro-1,3,5-triazine | 20 mg/m² |

Lower protective layer:

| | |
|---|---|
| Gelatin | 0.5 g/m² |
| 5-Nitroindazole | $1\times10^{-3}$ mol/mol of Ag |
| Polyethyl acrylate latex | 100 mg/m² |

Upper protective layer:

| | |
|---|---|
| Gelatin | 0.7 g/m² |
| Dye | as shown in Table 1 |
| Silica matting agent (average particle size: 3.0 μm) | 40 mg/m² |
| Fluorinated surfactant (d) | |
| Sodium dodecylbenzenesulfonate | 80 mg/m² |

Desensitizer (b)

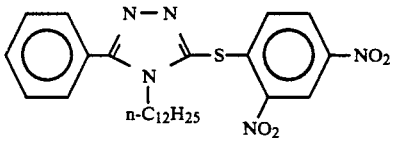

Polyethylene oxide (c)

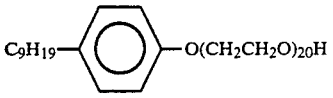

Fluorinated surfactant (d)

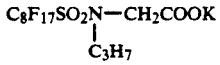

The dyes were added in the following manners: (1) The water-soluble dye (1) or (2) dissolved in water were added to the upper protective layer. (2) A surfactant (e), a mordant (f) and the above water-soluble dye (1) each dissolved in water were added to the upper protective layer. (3) One (1) gram of a dye (3) or (4) of the present invention and 2.65 g of Triton X-200 (6.7 wt % aqueous solution) as a dispersant were added to 21.7 ml of water and dispersed with a ball-mill for 4 days (particle size: 0.45 μm).

Water-soluble dye (1)

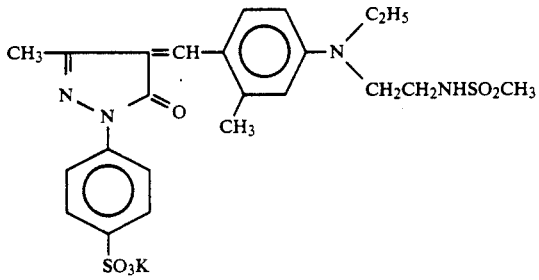

Water-soluble dye (2)

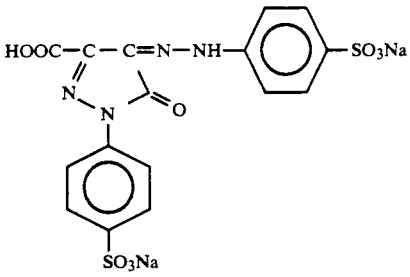

Surfactant (e)

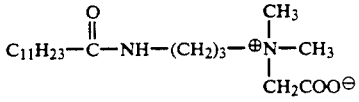

(50 mg/m²)

Surfactant (f)

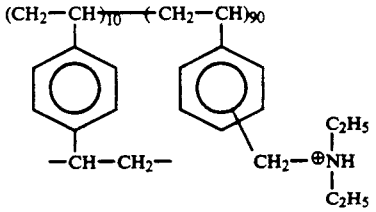

(1 g/m²)

Dye (3)

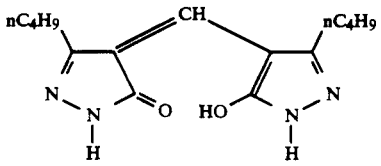

Dye (4)

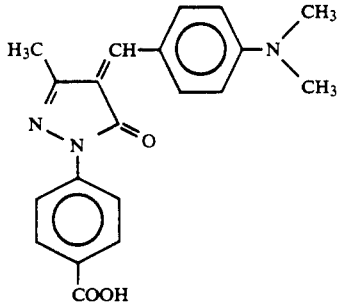

The support was provided with a back layer and a back protective layer each having the following composition. The swelling rate of the back side was 110%.

Back layer:

| | |
|---|---|
| Gelatin | 170 mg/m² |
| Sodium dodecylbenzenesulfonate | 32 mg/m² |
| Sodium dihexyl-α-sulfosuccinate | 35 mg/m² |
| $SnO_2$/Sb (9/1 by weight ratio, average particle size: 0.25 μm) | 318 mg/m² |

Back protective layer:

| | |
|---|---|
| Gelatin layer | 2.7 g/m² |
| Silica matting agent (average particle size: 3.5 μm) | 26 mg/m² |
| Sodium dihexyl-α-sulfosuccinate | 20 mg/m² |
| Sodium dodecylbenzenesulfonate | 67 mg/m² |
| $C_8F_{17}SO_2N(C_3H_7)-(CH_2CH_2O)_n-(CH_2)_4-SO_3Li$ | 5 mg/m² |
| Dye A | 190 mg/m² |

-continued

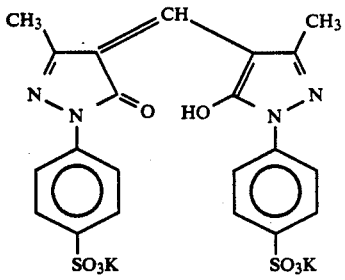

Dye B 32 mg/m²

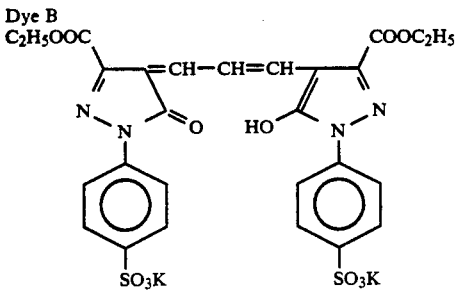

Dye C 59 mg/m²

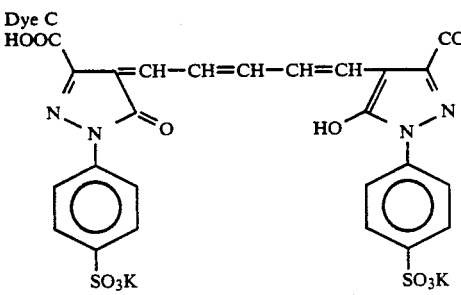

| | |
|---|---|
| Polyethyl acrylate latex (average particle size: 0.05 μm) | 260 mg/m² |
| 1,3-Divinylsulfonyl-2-propanol | 149 mg/m² |

Photographic properties

Sensitivity:

Each sample was exposed through an optical wedge with a printer P607 manufactured by Dainippon Screen Co., Ltd. and was then subjected to development processing at 38° C. for 20 seconds with an automatic processing machine FG-660F manufactured by Fuji Photo Film Co., Ltd. and then fixed in a fixing solution of GR-Fl made by Fuji Photo Film CO., Ltd. The developing solution had the following composition. Sensitivity as used herein is defined as the logarithm of a reciprocal of an exposure giving a density of 1.5, and is expressed relative to that of Sample No. 1 taken as 100.

Developing solution

| | |
|---|---|
| Hydroquinone | 35.0 g |
| N-Methyl-p-aminophenol ½ sulfate | 0.8 g |
| Sodium hydroxide | 9.0 g |
| Potassium tertiary phosphate | 74.0 g |
| Potassium sulfite | 90.0 g |
| Disodium ethylenediaminetetraacetate | 1.0 g |
| 3-Diethyl-amino-1-propanol | 15.0 g |
| 5-Methylbenzotriazole | 0.5 g |
| Sodium bromide | 3.0 g |
| Water was added to | 1 liter |
| pH was adjusted to | 11.60 |

Dmin:

A halftone dot original of 50% dot area was converted to a halftone dot of 50% dot area, and the density of the background was measured (corresponding to Dmin in practical use).

Safelight property:

A sample first subjected to a contact exposure such that a halftone dot original of 50% dot area was converted to a halftone dot of 50% dot area was then exposed to a luminous energy of 200 lux with a fluorescent lamp from which UV was removed by a cut-off filter, and the time necessary for the halftone dot area to decrease by 2% was measured.

Spreading and chalkinq properties:

A sample was exposed in the manner indicated in FIG. 1 for 1 minute, and the broadening of an original line width was measured. The exposure apparatus of FIG. 1 includes light source (metal halide) 1, diffusive sheet 2, glass 3, original (having an emulsion layer positioned on the upper surface) 4, spacer (175 μm) 5, raw film (having an emulsion layer positioned on the upper surface) 6, and backing sheet 7.

The development processing in the above evaluations was carried out in the same manner as in the sensitivity measurements.

The results are shown in Table 1.

TABLE 1

| | | Dye in light-insensitive layer | | | | | | |
|---|---|---|---|---|---|---|---|---|
| Sample No. | Emulsion | Type | Manner of Addition | Addition Amount (mg/m²) | Photographic property Sensitivity | Photographic property Dmin | Broadening of line (μm) | Safelight property (sec) |
| 1 (Comp.) | A | (1) | (1) | 150 | 100 | 0.07 | 75 | 10 |
| 2 (Comp.) | A | (2) | (1) | 100 | 100 | 0.07 | 50 | 7 |
| 3 (Comp.) | A | (1) | (2) | 150 | 95 | 0.07 | 90 | 12 |
| 4 (Inv.) | A | (3) | (3) | 150 | 100 | 0.05 | 200 | 25 |
| 5 (Inv.) | A | (4) | (3) | 150 | 100 | 0.05 | 195 | 25 |
| 6 (Comp.) | B | (1) | (1) | 150 | 105 | 0.07 | 80 | 8 |
| 7 (Comp.) | B | (2) | (1) | 100 | 102 | 0.07 | 60 | 6 |
| 8 (Comp.) | B | (1) | (2) | 150 | 102 | 0.07 | 100 | 9 |
| 9 (Inv.) | B | (3) | (3) | 150 | 102 | 0.05 | 220 | 23 |
| 10 (Inv.) | B | (4) | (3) | 150 | 102 | 0.05 | 200 | 25 |
| 11 (Comp.) | C | (1) | (1) | 150 | 105 | 0.07 | 85 | 8 |
| 12 (Comp.) | C | (2) | (1) | 100 | 102 | 0.07 | 70 | 6 |
| 13 (Inv.) | C | (3) | (3) | 150 | 105 | 0.05 | 230 | 17 |
| 14 (Inv.) | C | (4) | (3) | 150 | 102 | 0.05 | 200 | 18 |
| 15 (Comp.) | D | (1) | (1) | 150 | 105 | 0.07 | 89 | 6 |
| 16 (Comp.) | D | (2) | (1) | 100 | 102 | 0.07 | 78 | 6 |
| 17 (Inv.) | D | (3) | (3) | 150 | 102 | 0.05 | 250 | 14 |

TABLE 1-continued

| Sample No. | Emulsion | Dye in light-insensitive layer Type | Manner of Addition | Addition Amount (mg/m²) | Photographic property Sensitivity | Dmin | Broadening of line (μm) | Safelight property (sec) |
|---|---|---|---|---|---|---|---|---|
| 18 (Inv.) | D | (4) | (3) | 150 | 105 | 0.05 | 240 | 13 |

It is clearly seen from the results presented in Table 1, Samples No. 4, 5, 9, 10, 13, 14, 17, and 18 of the invention exhibited a larger broadening of line width and hence good spreading and chalking properties, as well as an excellent safelight property and Dmin at the same sensitivity level.

EXAMPLE 2

The following Emulsions E, F and G were prepared.

Emulsion E:

Emulsion E was prepared in the same manner as Emulsion A, except that $(NH_4)_3RhCl_6$ was replaced by $(NH_4)_3Rh(NO)Cl_5$.

Emulsion F:

Emulsion F was prepared in the same manner as Emulsion A, except that $(NH_4)_3RhCl_6$ was replaced by $K_2Re(NO)Cl_5$.

Emulsion G:

Emulsion G was prepared in the same manner as Emulsion A, except that $(NH_4)_3RhCl_6$ was replaced by $K_2Re(NO)Cl_5$.

These emulsions were divided and the same components as those of Example 1 were added. Then, the water-soluble dye (g) was added (15 mg/m²), and the coating was carried out to provide the same layer structure as that of Example 1. The respective samples were evaluated in the same manner as Example 1. The results are shown in Table 2.

Water-soluble dye (g)

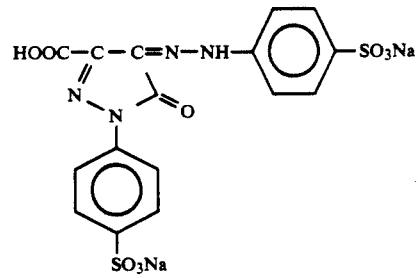

TABLE 2

| Sample No. | Emulsion | Dye in light-insensitive layer Type | Manner of Addition | Addition Amount (mg/m²) | Photographic property Sensitivity | Dmin | Broadening of line (μm) | Safelight property (sec) |
|---|---|---|---|---|---|---|---|---|
| 19 (Inv.) | A | (3) | (3) | 100 | 100 | 0.05 | 200 | 25 |
| 20 (Inv.) | A | (4) | (3) | 100 | 100 | 0.05 | 195 | 25 |
| 21 (Inv.) | A | (4) | (3) | 150 | 83 | 0.05 | 190 | 30 |
| 22 (Inv.) | E | (3) | (3) | 100 | 102 | 0.04 | 200 | 23 |
| 23 (Inv.) | E | (4) | (3) | 100 | 100 | 0.04 | 195 | 25 |
| 24 (Inv.) | E | (4) | (3) | 150 | 85 | 0.04 | 190 | 25 |
| 25 (Inv.) | F | (3) | (3) | 100 | 100 | 0.04 | 200 | 20 |
| 26 (Inv.) | F | (4) | (3) | 100 | 100 | 0.04 | 195 | 20 |
| 27 (Inv.) | F | (4) | (3) | 150 | 83 | 0.04 | 190 | 25 |

It is clearly seen from the results summarized in Table 2 that Samples No. 22 to 27 prepared using Emulsions E and F exhibited improved Dmin as compared to Sample Nos. 19 to 21 prepared using Emulsion A.

EXAMPLE 3

Samples were prepared in the same manner as in Example 1 using the Emulsion A, except that to Emulsion A were added the dye (3) dispersed in microcrystalline particulate form and the water-soluble dye (2) as indicated in Table 3 to obtain Sample Nos. 28 to 44.

The tone reproducibility of the samples thus prepared was evaluated by determining the reproducibilities of 1% and 99% dot areas obtained when a 50% dot area of an original consisting of the halftone dots of 150 lines was converted to a halftone dot of a 50% dot area. Tone reproducibility was judged as excellent when a 1% dot area of an original was converted to a halftone dot of a 1% dot area, and a 99% dot area of the original was converted to a halftone dot of a 99% dot area. Other properties were evaluated in the same manners as Example 1. The results are shown in Table 3.

TABLE 3

| Sample No. | Dye in Protective layer Type | Manner of Addition | Addition amount (mg/m²) | Dye in Emulsion layer Type | Manner of Addition | Addition amount (mg/m²) | Photographic property Sensitivity | Dmin | Broadening of line (μm) | Tone reproducibility | Safelight property (sec) |
|---|---|---|---|---|---|---|---|---|---|---|---|
| 28 (Comp.) | — | — | — | — | — | — | 100 | 0.05 | 250 | 3%-99% | 2 |
| 29 (Comp.) | — | — | — | (2) | (1) | 20 | 79 | 0.05 | 190 | 2%-99% | 3 |

TABLE 3-continued

| Sample No. | Dye in Protective layer Type | Manner of Addition | Addition amount ($mg/m^2$) | Dye in Emulsion layer Type | Manner of Addition | Addition amount ($mg/m^2$) | Photographic property Sensitivity | Dmin | Broadening of line (μm) | Tone reproducibility | Safelight property (sec) |
|---|---|---|---|---|---|---|---|---|---|---|---|
| 30 (Comp.) | — | — | — | (2) | (1) | 60 | 50 | 0.06 | 78 | 1%-99% | 5 |
| 31 (Comp.) | — | — | — | (2) | (1) | 100 | 40 | 0.07 | 50 | 1%-99% | 7 |
| 32 (Comp.) | — | — | — | (3) | (3) | 50 | 71 | 0.05 | 195 | 2%-99% | 3 |
| 33 (Comp.) | — | — | — | (3) | (3) | 100 | 50 | 0.05 | 80 | 1%-99% | 5 |
| 34 (Comp.) | — | — | — | (3) | (3) | 150 | 40 | 0.06 | 60 | 1%-99% | 7 |
| 35 (Inv.) | (3) | (3) | 50 | (2) | (1) | 20 | 56 | 0.05 | 185 | 1%-99% | 13 |
| 36 (Inv.) | (3) | (3) | 50 | (2) | (1) | 60 | 35 | 0.06 | 70 | 1%-99% | 15 |
| 37 (Inv.) | (3) | (3) | 50 | (3) | (3) | 50 | 50 | 0.05 | 180 | 1%-99% | 15 |
| 38 (Inv.) | (3) | (3) | 50 | (3) | (3) | 100 | 35 | 0.06 | 74 | 1%-99% | 20 |
| 39 (Inv.) | (3) | (3) | 100 | (2) | (1) | 20 | 40 | 0.05 | 180 | 1%-99% | 27 |
| 40 (Inv.) | (3) | (3) | 100 | (2) | (1) | 60 | 25 | 0.06 | 55 | 1%-99% | 30 |
| 41 (Inv.) | (3) | (3) | 100 | (3) | (3) | 50 | 37 | 0.05 | 185 | 1%-99% | 28 |
| 42 (Inv.) | (3) | (3) | 100 | (3) | (3) | 100 | 24 | 0.06 | 60 | 1%-99% | 35 |
| 43 (Inv.) | (3) | (3) | 100 | — | — | — | 52 | 0.05 | 200 | 2%-99% | 25 |
| 44 (Inv.) | (3) | (3) | 150 | — | — | — | 40 | 0.05 | 195 | 2%-99% | 30 |

It is clearly seen from the results summarized in Table 3 that Sample Nos. 35, 37, 39 and 41 exhibited excellent spreading, Dmin and safelight properties, as well as excellent tone reproducibility.

In the direct positive type silver halide photographic light-sensitive material of the present invention, a dye dispersed in the form of microcrystalline particles is added to a light-insensitive layer provided farther from the support than a pre-fogged light-sensitive silver halide emulsion layer. A dye dispersed in the form of microcrystalline particles and/or a water-soluble dye may be further added to the silver halide emulsion layer. A direct positive type light-sensitive material of the present invention having excellent spreading and chalking properties, tone reproducibility and outline type preparation is thereby obtained.

While the invention has been described in detail and with reference to specific embodiments thereof, it will be apparent to one skilled in the art that various changes and modifications can be made therein without departing from the spirit and scope thereof.

What is claimed is:

1. A direct positive type silver halide photographic light-sensitive material comprising a support having thereon at least one pre-fogged light-sensitive silver halide emulsion layer containing fogged silver halide grains and at least one light-insensitive hydrophilic colloid layer provided farther from the support than the light-sensitive silver halide emulsion layer, wherein the light-insensitive hydrophilic colloid layer contains a dye dispersed therein in the form of microcrystalline particles.

2. The direct positive type silver halide photographic light-sensitive material as in claim 1, wherein the silver halide contained in the pre-fogged light-sensitive silver halide emulsion layer has a silver chloride content of 70 mol % or more.

3. The direct positive type silver halide photographic light-sensitive material as in claim 1, wherein the silver halide contained in the pre-fogged light-sensitive silver halide emulsion layer has a silver chloride content of 90 mol % or more.

4. The direct positive type silver halide photographic light-sensitive material as in claim 1, wherein, the silver halide grains comprising the pre-fogged light-sensitive silver halide emulsion layer contain a transition metal selected from the elements of groups V to VIII of the Periodic Table, said transition metal being formed with a nitrosyl or thionitrosyl ligand.

5. The direct positive type silver halide photographic light-sensitive material as in claim 1, wherein the pre-fogged light-sensitive silver halide emulsion layer further comprises a dye dispersed in the form of microcrystalline particles or a water-soluble dye in an amount such that the sensitivity of the silver halide emulsion layer is not lowered by 0.2 or more in log E.

6. The direct positive type silver halide photographic light-sensitive material as in claim 1, wherein the dye dispersed in the form of microcrystalline particles is contained in the light-insensitive hydrophilic colloid layer in an amount of from 10 to 500 $mg/m^2$.

* * * * *